US006658677B2

(12) United States Patent
Paul

(10) Patent No.: US 6,658,677 B2
(45) Date of Patent: Dec. 9, 2003

(54) SYSTEM FOR REPLACING DECORATIVE FURNITURE PANELS

(75) Inventor: Stewart Paul, Princeton Junction, NJ (US)

(73) Assignee: P. J. Kids, LLC, New York, NY (US)

( * ) Notice: Subject to any disclaimer, the term of this patent is extended or adjusted under 35 U.S.C. 154(b) by 0 days.

(21) Appl. No.: 10/060,814

(22) Filed: Feb. 1, 2002

(65) Prior Publication Data

US 2003/0145377 A1 Aug. 7, 2003

(51) Int. Cl.[7] ..... A47C 23/00; A47G 29/00

(52) U.S. Cl. ..... 5/280; 5/285; 5/907; 312/265.6; 312/348.4; 16/417

(58) Field of Search ..... 312/348.4, 348.6, 312/265.6; 16/415, 417; 5/280, 53.1, 285, 907

(56) References Cited

U.S. PATENT DOCUMENTS 2,068,922 A * 1/1937 Marchand ..... 16/417
2,550,762 A * 5/1951 Bockus ..... 40/727
2,687,537 A * 8/1954 Wallace et al. ..... 5/280
2,842,420 A * 7/1958 Hansen et al. ..... 312/348.6
3,416,850 A * 12/1968 Hilfinger et al. ..... 312/348.1
3,585,356 A 6/1971 Hall
3,697,363 A * 10/1972 Martinez ..... 428/67
3,773,399 A * 11/1973 Sulcek ..... 312/204
4,103,375 A 8/1978 Santo
4,202,586 A 5/1980 Oplinger
4,701,066 A 10/1987 Beam et al.
4,924,846 A 5/1990 Peacock et al.
5,173,974 A 12/1992 Proano et al.
5,335,605 A 8/1994 Drabczyk
5,806,942 A * 9/1998 Jenkins et al. ..... 312/204
5,921,647 A 7/1999 Schneider et al.
5,951,133 A 9/1999 Dittberner et al.
6,053,585 A * 4/2000 Osen ..... 312/204
6,123,031 A 9/2000 Hayman-Chaffey
6,543,071 B1 * 4/2003 Lenner ..... 5/280

* cited by examiner

*Primary Examiner*—Michael F. Trettel
(74) *Attorney, Agent, or Firm*—Norman E. Lehrer

(57) ABSTRACT

A system for replacing furniture panels which includes a frame secured to a piece of furniture and a panel which may be inserted or otherwise slid into the frame and secured therein is disclosed. The panel has front and rear surfaces having different appearances and either surface can be exposed. This allows the decor of the furniture to be easily and quickly changed at will.

2 Claims, 3 Drawing Sheets

SYSTEM FOR REPLACING DECORATIVE FURNITURE PANELS

BACKGROUND OF THE INVENTION

The present invention is directed toward a system for replacing decorative furniture panels and more particularly, toward decorative panels which may be replaced easily and as often as desired by the consumer in order to change the appearance of his or her furniture.

People often desire a change in the motif or appearance of their furniture. In particular, people often change the look of their bedroom. Also, as children grow older their likes and dislikes change. In addition, styles frequently change over the years. Thus, while the child's furniture itself may be still be serviceable, the decor for an infant may not be suitable for a young child or adolescent. The problem however, is that it may not be very economical to change furniture as often as a person desires, especially when the furniture is still in good condition.

Several patents suggest systems for changing the look of certain pieces of furniture. For example, U.S. Pat. No. 5,921,647 to Schneider et al. discloses a replaceable panel for various types of furniture. This patent discloses components for furniture which comprise a plurality of frame components and at least one panel which is received within the frame component. The panels may be changed in order to alter the appearance of the furniture.

U.S. Pat. No. 4,103,375 to Santo discloses decorative panels which slide into or out of support channels on a waterbed frame in order to change its decor. Also, U.S. Pat. No. 6,123,031 to Hayman-Chaffey discloses a table with a decorative insert that can be slid into or out of a groove for changing the appearance of the tabletop.

While the patents discussed above provide for various ways to change the appearance of various pieces of furniture, they appear to be rather cumbersome and not very simple to accomplish. Therefore, a need exists for a system of changing the panels of various pieces of furniture in a simple manner thereby allowing the same to be accomplished by the average unskilled homeowner.

SUMMARY OF THE INVENTION

The present invention is designed to overcome the deficiencies of the prior art discussed above. It is an object of the present invention to provide a simple system for replacing furniture panels.

It is another object of the present invention to provide a system for replacing decorative furniture panels so that the look of the furniture may be changed easily.

In accordance with the illustrative embodiments demonstrating features and advantages of the present invention, there are provided furniture panels which may be replaced easily and as often as desired by the consumer. The system includes a frame secured to a piece of furniture and a panel which may be inserted or otherwise slid into the frame and easily secured therein.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
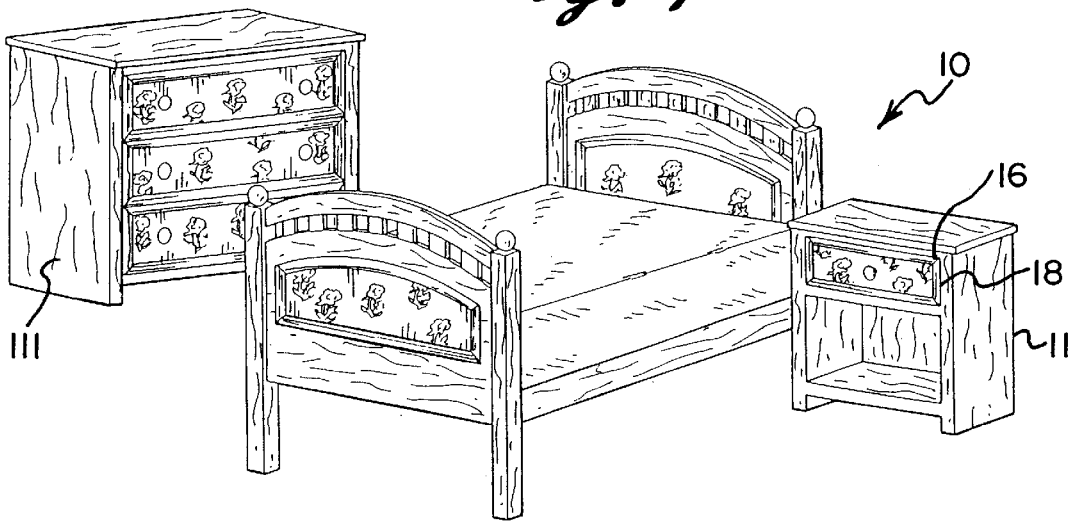
FIG. 1 illustrates a bedroom set using the decorative panels in accordance with the present invention.

Referring now to the drawings in detail wherein like reference numerals have been used throughout the various figures to designate like elements, there is shown in FIG. 1 a bedroom set utilizing a furniture panel system constructed in accordance with the principles of the present invention and designated generally as 10.

Figure 2:
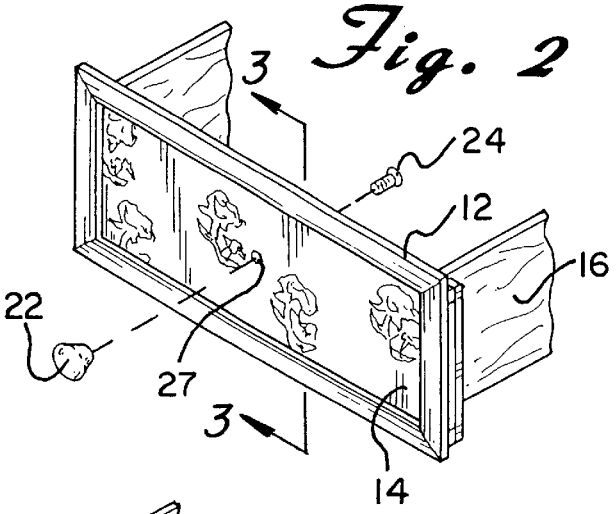
FIG. 2 is a perspective view of a drawer panel of the present invention.
Figure 3:
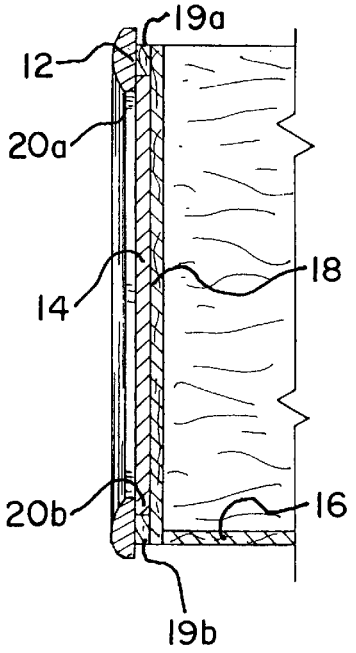
FIG. 3 is a cross-sectional view taken through line 3—3 of FIG. 2.
Figure 4:
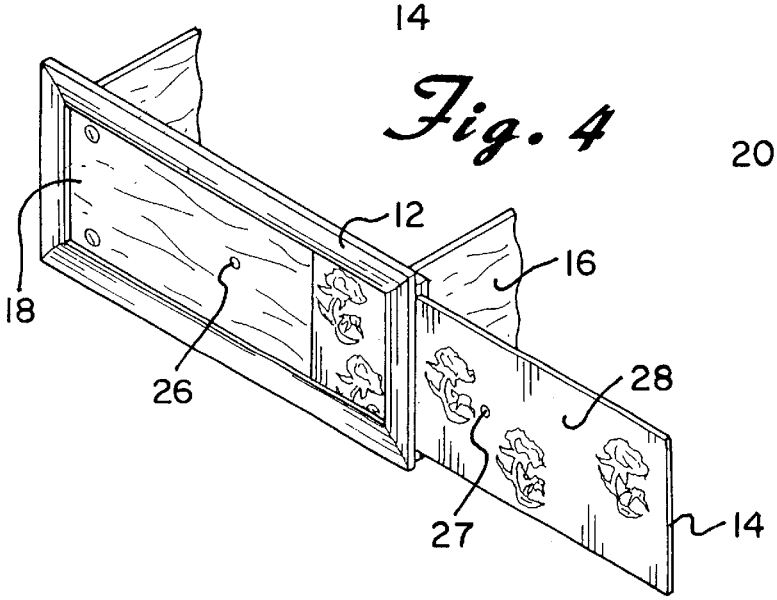
FIG. 4 is a perspective view similar to FIG. 2 but illustrating a panel being slidably mounted within a drawer front frame in accordance with the present invention.

A first embodiment of the present invention is shown in FIGS. 2–5 wherein the invention is applied to a night stand 11 or similar piece of furniture. The furniture panel system essentially includes a frame 12 and a decorative panel 14 with the frame 12 being located at the front of a drawer 16 as best shown in FIGS. 2, 3, and 4. The frame 12 is secured to a drawer front 18 and the panel 14 is shown inserted into the frame 12. (See FIGS. 3 and 4.) The frame 12 is spaced from the drawer front 18 by spacers 19*a* and 19*b* located at the top and bottom and a similar spacer (not shown) located along the left side, the right side being left open thereby forming grooves or channels 20*a* and 20*b* within which the edges of the panel 14 may be slid and held in place from vertical movement.

As is typical in the art, a drawer pull 22 in the form of a knob or the like is also provided. The knob 22 is secured in place in a conventional manner through the use of a screw 24 passing through hole 26 in the center of drawer front 18. A similar hole 27 is formed in the center of panel 14 and is arranged so that when the panel 14 is properly inserted into place within the frame 12, the two holes 26 and 27 are in alignment with each other to allow the screw 24 to pass there through in order to secure the knob 22 in place.

In order to change the panel 14 and, therefore, the appearance of the front of the drawer 16, the knob or other drawer pull 22 is removed by removing the screw 24. The panel 14 is then slid out of the frame 12 as shown in FIG. 4. A second different panel can then be inserted into the frame 12 and the knob 22 is reattached in the manner described above.

Figure 5:
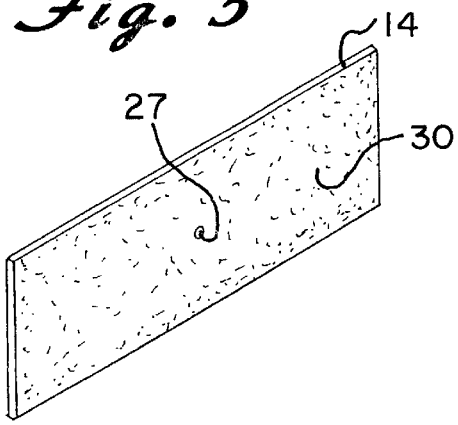
FIG. 5 is a rear perspective view of the panel shown in FIGS. 1–4.

In lieu of inserting a new panel, it is also possible with the present invention to simply reverse the panel 14. As shown in FIGS. 1–4, the panel 14 has a front side 28 which has a design thereon or is otherwise decorated or colored. As shown in FIG. 5, the panel 14 also has a rear side 30 which is colored or has a design which differs from the design on the front side 28. Thus, instead of providing a new panel, the panel 14 may simply be reversed and inserted into the frame.

While only one panel has been described, it should be understood that a variety of panels may be used. Furthermore, in lieu of a single panel, it is possible that two or more smaller panels may be arranged in the frame next to each other to provide different patterns. Even further, it is within the scope of the present invention to provide a plurality of panels with each of the panels having the same overall size but of half or one third the thickness. In this way, a plurality of panels of different design can be stored in the frame 12 instead of the single panel 14 with the design of only the outermost panel being visible.

The invention has thus far been described with respect to a night stand of a bedroom set 10. As should be readily apparent to persons of ordinary skill in the art, the panels and frames may be secured to different types of furniture for use in a bedroom and otherwise as will be discussed in greater detail below.

Figure 6:
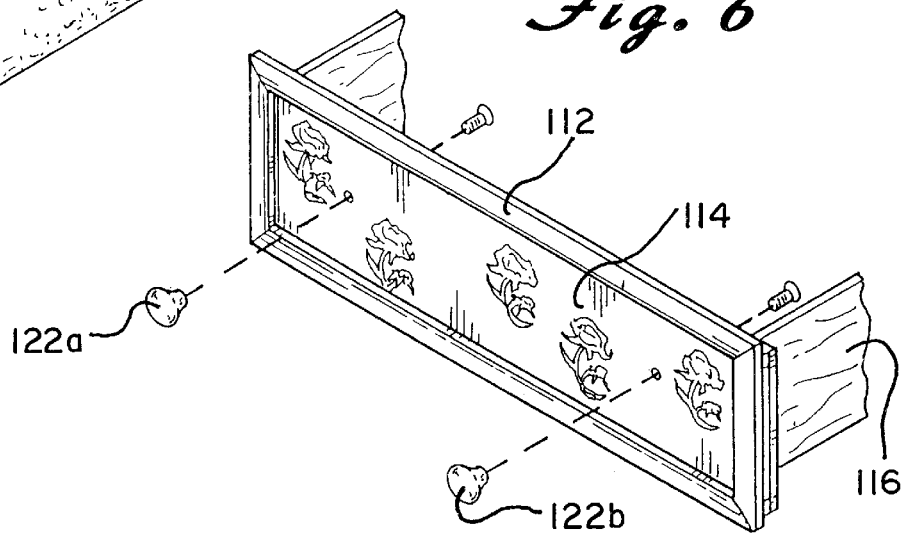
FIG. 6 is a perspective view of a drawer panel of a second embodiment of the present invention.
Figure 7:
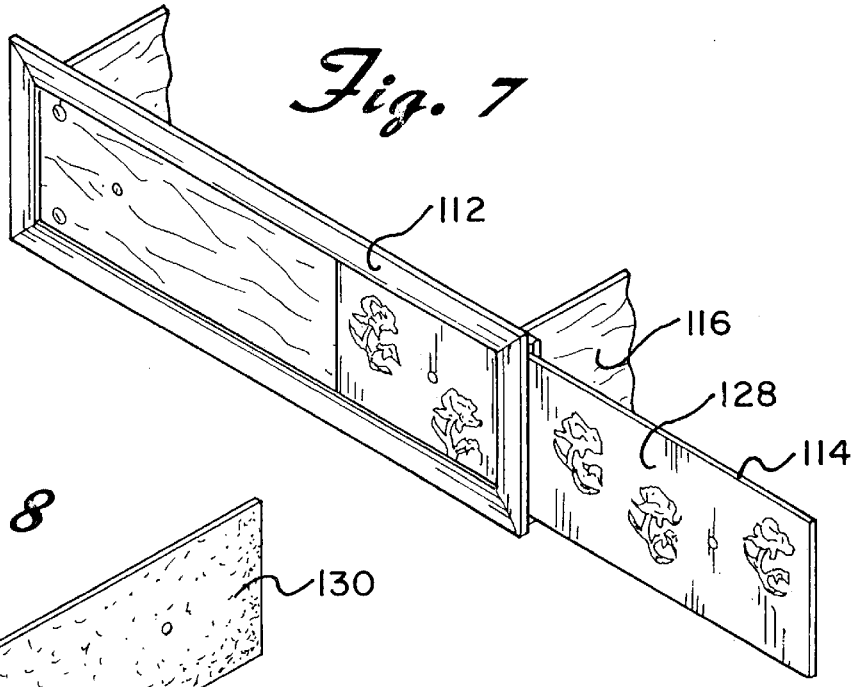
FIG. 7 is a perspective view similar to FIG. 4 but illustrating the panel of the second embodiment slidably mounted within a frame.
Figure 8:
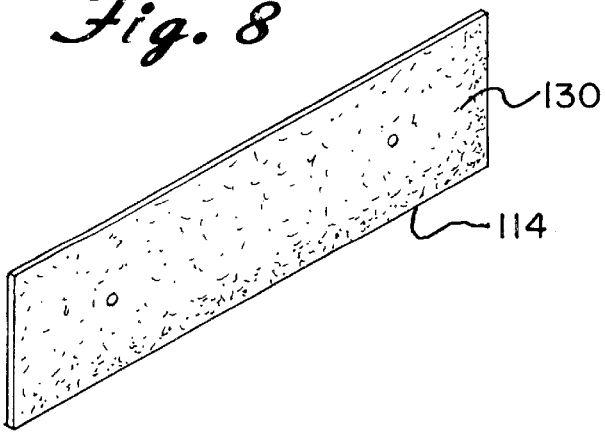
FIG. 8 is a rear perspective view of the panel shown in FIG. 7.

FIGS. 6, 7, and 8, for example, show a second embodiment of the invention that may be used on a dresser 111. A frame 112 and panel 114 for a dresser drawer 116 with two drawer pulls or knobs 122*a* and 122*b* is shown. This panel and frame function in the same manner described above except that two rather than one knob must be removed from the panel and drawer before the panel is changed. (See FIG. 6.) Again, once the knobs 122*a* and 122*b* have been removed, the panel 114 may be slid out of the frame 112. (See FIG. 7.) The panel 114 has a front side 128 which is colored or has a design different from the color and/or design on the reverse side 130 of the panel 114. The panel may be reversed or a different panel inserted into the frame in the manner described above.

Figure 9:
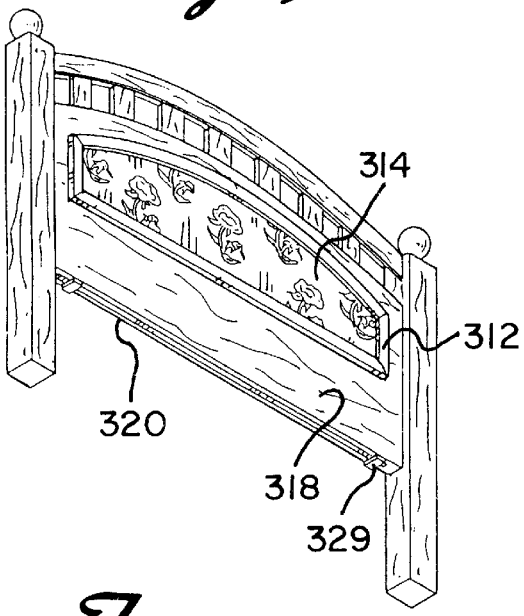
FIG. 9 is a perspective of the head or foot board of a bed utilizing the present invention.
Figure 10:
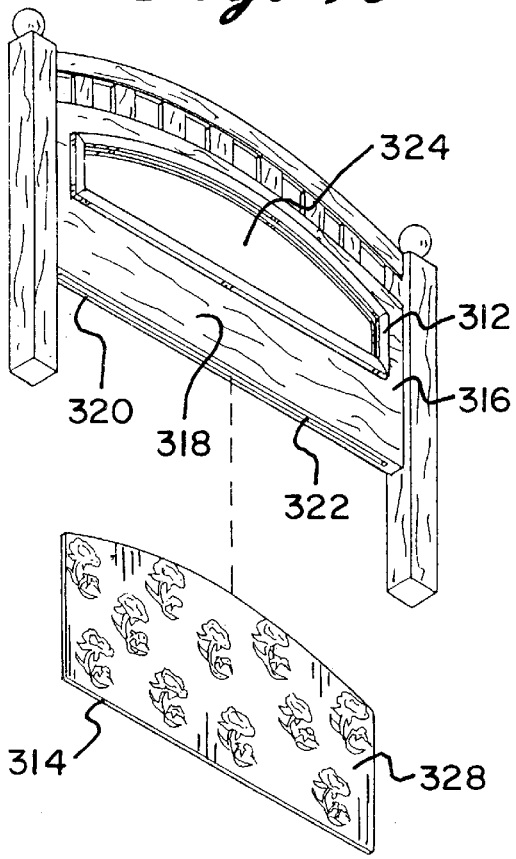
FIG. 10 illustrates a decorative panel being slidably mounted within the frame of the head or foot board of FIG. 9.

FIGS. 9–12 illustrate a frame 312 and panel 314 of the present invention used in the foot board (or head board) 316 of a bed. The foot board 316, for example, is comprised of front and rear planer members 318 and 320 that are spaced apart from each other by a gap 322 having a thickness that is slightly greater than the thickness of the panel 314. As best shown in FIGS. 9 and 10, the gap 322 is open at the bottom so that the panel 314 can be slid upwardly into place.

The foot board 316 also has opening or window 324 formed there through which is framed by the frame 312 preferably on the front and back thereof. When the panel 314 is slid into place, its decorative face 328 is visible through the window 324. The panel 314 is held in place, that is, it is prevented from dropping downwardly by the use of clips 329, or the like that are attached to the bottom of the foot board 316 across the gap 322. Preferably, the clips 329 are secured to only the front or back of the frame and can be rotated by hand into and out of place so that the panel 314 can be easily and quickly removed and replaced.

Figure 11:
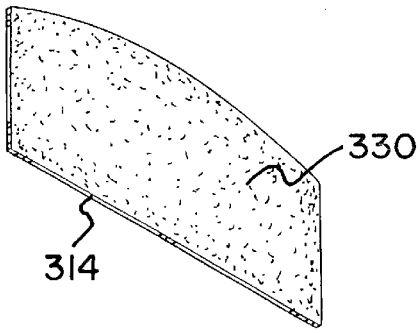
FIG. 11 is a rear perspective view of the decorative panel of FIGS. 9 and 10.
Figure 12:
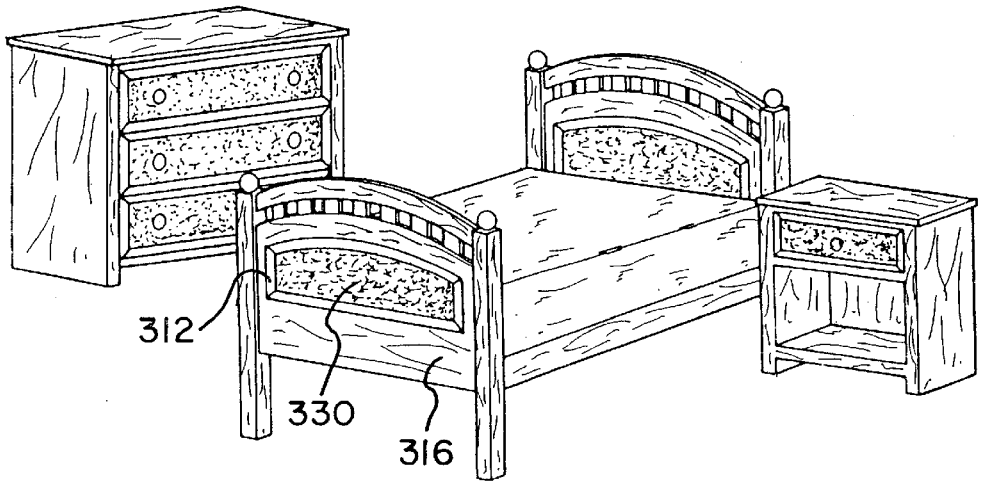
FIG. 12 is a view similar to FIG. 1 illustrating a bedroom set using the reverse side of the decorative panel shown in FIG. 1.

As in the embodiments discussed above, the panel 314 has a front side 328 and rear side 330 wherein the rear side 330 has a color or design that is different from the front side 328 as shown in FIG. 11. In this regard, FIG. 12 illustrates the same bedroom set as illustrated in FIG. 1 but with each of the panels in each of the night stand 11, dresser 111 and head and foot boards 316 being reversed to show the rear sides thereof.

The present invention may be embodied in other specific forms without departing from the spirit or essential attributes thereof. Furthermore, the invention is not limited to bedroom furniture but is equally applicable to other pieces of furniture. Accordingly, reference should be made to the appended claims rather than to the foregoing specification as indicating the scope of the invention.

I claim:

1. A system for replacing furniture panels on the face of a drawer comprising:

a drawer having a drawer front;

a frame member attached to the face of said drawer front around the outer periphery thereof;

said frame member being spaced from said drawer front by spacer means located around the periphery of said drawer front except for one side thereof to thereby leave a groove that is open at one end to slidably insert a decorative panel between said frame member and said drawer front;

and means for maintaining said panel including a drawer pull secured to the front of said panel and a screw passing through said drawer front and said panel and secured to said drawer pull.

2. The invention as claimed in claim 1 wherein said panel has different appearances on its front and rear surfaces and wherein said panel can be attached to said drawer front with either surface being exposed.

* * * * *

UNITED STATES PATENT AND TRADEMARK OFFICE

CERTIFICATE OF CORRECTION

PATENT NO. : 6,658,677 B2
DATED : December 9, 2003
INVENTOR(S) : Stewart Paul

It is certified that error appears in the above-identified patent and that said Letters Patent is hereby corrected as shown below:

Column 4,
Line 42, “in place” should appear before -- including --.

Signed and Sealed this

Ninth Day of March, 2004

JON W. DUDAS
*Acting Director of the United States Patent and Trademark Office*